US010226857B2

(12) United States Patent
Moore

(10) Patent No.: US 10,226,857 B2
(45) Date of Patent: Mar. 12, 2019

(54) REVERSIBLE BUSHING

(71) Applicant: Caterpillar Inc., Peoria, IL (US)

(72) Inventor: Cody Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 147 days.

(21) Appl. No.: 15/297,249

(22) Filed: Oct. 19, 2016

(65) Prior Publication Data

US 2018/0104806 A1 Apr. 19, 2018

(51) Int. Cl.

*B25D 9/04* (2006.01)
*E02F 3/96* (2006.01)
*B25D 17/08* (2006.01)

(52) U.S. Cl.

CPC ..... *B25D 9/04* (2013.01); *B25D 17/08* (2013.01); *E02F 3/966* (2013.01); *B25D 2217/0019* (2013.01); *B25D 2250/105* (2013.01); *B25D 2250/231* (2013.01)

(58) Field of Classification Search

CPC ..... E02F 3/966; B25D 2250/231; B25D 2250/105; B25D 2217/0019

See application file for complete search history.

(56) References Cited

U.S. PATENT DOCUMENTS 6,510,904 B1 1/2003 Tyrrell
7,861,799 B2 1/2011 Iwakami et al.
2009/0090471 A1* 4/2009 Rosso ..... B44C 7/02 156/579

FOREIGN PATENT DOCUMENTS

CN 103894860 7/2014

* cited by examiner

*Primary Examiner* — John C Hong

(57) ABSTRACT

A reversible bushing for a hydraulic hammer is provided. The reversible bushing includes a body having a first end, a second end, an inner surface, and an outer surface. The reversible bushing includes a first notch provided in relation to a center of symmetry. The reversible bushing includes a first channel provided on the first end of the body. The reversible bushing includes a second channel provided on the second end of the body. The reversible bushing also includes a first groove provided on the first end of the body. The reversible bushing further includes a second groove provided on the second end of the body. The first channel and the second channel are equidistant with respect to the center of symmetry. The first groove and the second groove are equidistant with respect to the center of symmetry.

18 Claims, 7 Drawing Sheets

REVERSIBLE BUSHING

TECHNICAL FIELD

The present disclosure relates to a reversible bushing. More particularly, the present disclosure relates to the reversible bushing associated with a hydraulic hammer.

BACKGROUND

Hydraulic hammers are used at various work sites for fracturing objects, such as rocks, concrete, asphalt, frozen ground, and other materials. The hydraulic hammers include a bushing that acts as a guiding agent. The bushing is provided between a power cell and a work tool of the hydraulic hammer.

During operation, the bushing may wear out over a period of time. Excessive wear of the bushing may result in misalignment of the work tool with respect to the power cell, thereby leading to a premature failure of the hydraulic hammer. In a situation when the bushing may wear beyond a predefined wear limit, the bushing may require immediate repair or replacement to avoid wear and abrasion of the work tool and the power cell of the hydraulic hammer.

Generally, the bushing may experience wear and tear only on an end thereof disposed at an opening of the power cell. The opening of the power cell may refer to an end of the power cell through which the work tool may extend outwards. However, another end of the bushing disposed distal to the first end and within the power cell may not experience the same amount of wear and tear as the first end. In such a situation, the another end of the bushing may have a usable life thereof remaining before the complete bushing may be discarded due to complete wear.

Also, the bushing may have to be aligned and used within the power cell in a predefined configuration. As such, the bushing may not be used reversibly due to design restriction, thus rendering the another end of the bushing unused in spite of having some amount of usable life remaining. Hence, there is a need for an improved bushing for the hydraulic hammers.

SUMMARY OF THE DISCLOSURE

In an aspect of the present disclosure, a reversible bushing for a hydraulic hammer is provided. The reversible bushing includes a body having an elongated configuration defining a longitudinal axis. The body has a first end and a second end distal with respect to the first end. The body has an inner surface and an outer surface disposed opposite with respect to the inner surface. The body defines a center of symmetry on the longitudinal axis. The reversible bushing includes a first notch provided in relation to the center of symmetry. The first notch extends at least partially along the body. The reversible bushing includes a first channel provided on the first end of the body. The first channel extends at least partially along the inner surface of the body. The reversible bushing includes a second channel provided on the second end of the body. The second channel extends at least partially along the inner surface of the body. The reversible bushing also includes a first groove provided on the first end of the body. The first groove is provided spaced apart with respect to the first channel. The first groove extends at least partially along the inner surface of the body. The reversible bushing further includes a second groove provided on the second end of the body. The second groove is provided spaced apart with respect to the second channel. The second groove extends at least partially along the inner surface of the body. The first channel and the second channel are equidistant with respect to the center of symmetry. The first groove and the second groove are equidistant with respect to the center of symmetry.

In another aspect of the present disclosure, a reversible bushing kit for a hydraulic hammer is provided. The reversible bushing kit includes a reversible bushing. The reversible bushing includes a body having an elongated configuration defining a longitudinal axis. The body has a first end and a second end distal with respect to the first end. The body has an inner surface and an outer surface disposed opposite with respect to the inner surface. The body defines a center of symmetry on the longitudinal axis. The reversible bushing includes a first notch provided in relation to the center of symmetry. The first notch extends at least partially along the body. The reversible bushing includes a first channel provided on the first end of the body. The first channel extends at least partially along the inner surface of the body. The reversible bushing includes a second channel provided on the second end of the body. The second channel extends at least partially along the inner surface of the body. The reversible bushing also includes a first groove provided on the first end of the body. The first groove is provided spaced apart with respect to the first channel. The first groove extends at least partially along the inner surface of the body. The reversible bushing further includes a second groove provided on the second end of the body. The second groove is provided spaced apart with respect to the second channel. The second groove extends at least partially along the inner surface of the body. The first channel and the second channel are equidistant with respect to the center of symmetry. The first groove and the second groove are equidistant with respect to the center of symmetry. The reversible bushing kit also includes a sealing element selectively provided within the first groove and the second groove.

In yet another aspect of the present disclosure, a method of using a reversible bushing within a hydraulic hammer is provided. The reversible bushing has a first end and a second end distal with respect to the first end. The method includes providing a sealing element within a first groove provided on the first end. The method includes providing a sealing element within a third groove provided on the first end. The method includes assembling the reversible bushing within the hydraulic hammer with the second end inserted first. The method includes determining an end of life of the first end based on an operation of the hydraulic hammer. The method includes disassembling the reversible bushing from the hydraulic hammer. The method includes providing a sealing element within a second groove provided on the second end. The method also includes providing a sealing element within a fourth groove provided on the second end. The method further includes reassembling the reversible bushing within the hydraulic hammer with the first end inserted first.

Other features and aspects of this disclosure will be apparent from the following description and the accompanying drawings.

DETAILED DESCRIPTION

Figure 1:
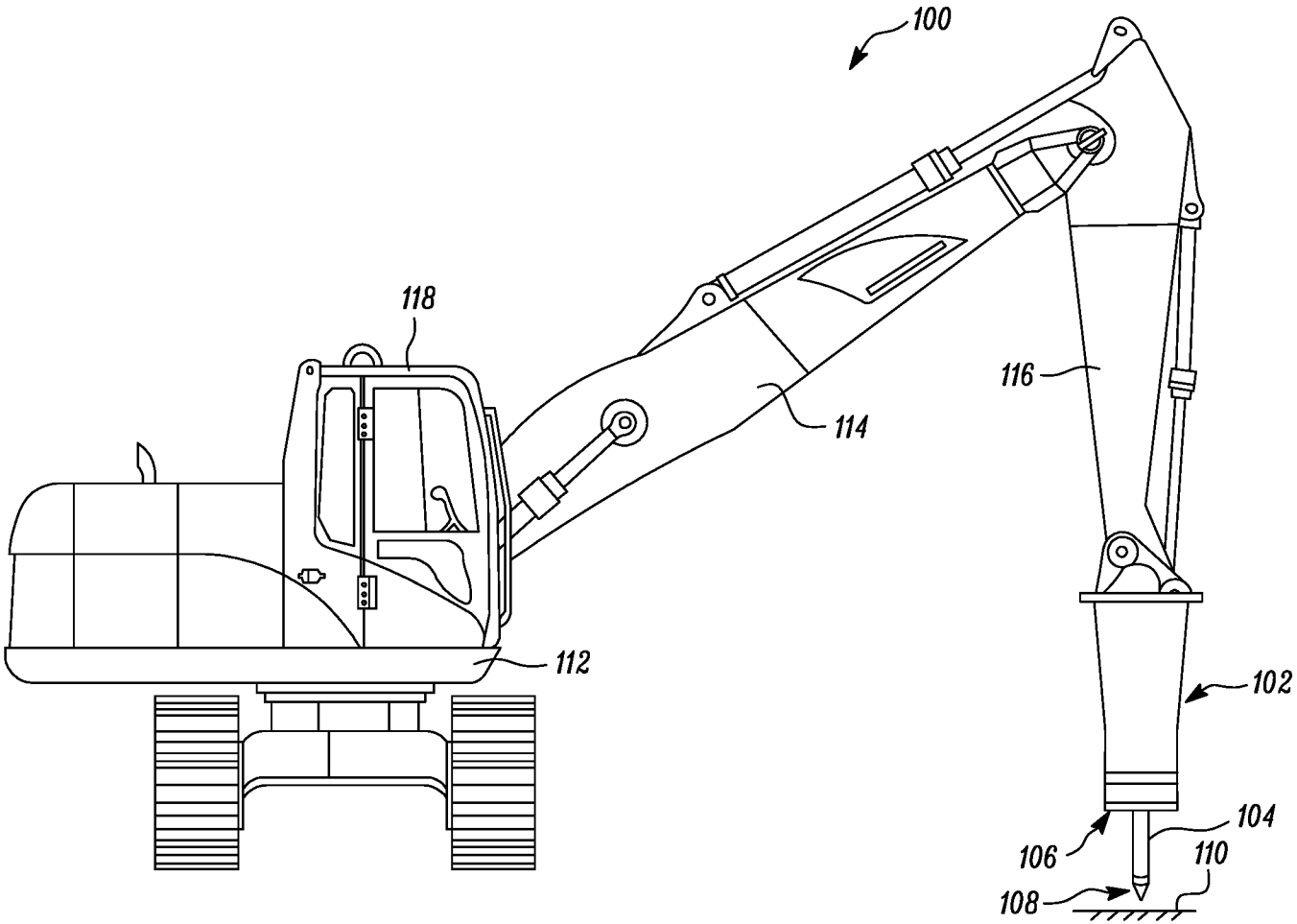
FIG. 1 is a side view of an exemplary machine, according to one embodiment of the present disclosure.

Wherever possible, the same reference numbers will be used throughout the drawings to refer to the same or the like parts. Referring to FIG. 1, an exemplary machine 100 is illustrated. The machine 100 is embodied as a tracked drill machine. The machine 100 includes a hydraulic hammer 102 provided thereon. The hydraulic hammer 102 includes a work tool 104. The work tool 104 includes a top portion 106 and a bottom portion 108. The top portion 106 is coupled to the hydraulic hammer 102. The bottom portion 108 of the work tool 104 contacts with a work surface 110 during an operation of the hydraulic hammer 102. The work tool 104 is adapted for performing activities including, but not limited to, fracturing/breaking rocks and penetrating ground surfaces.

A type of the work tool 104 may be based on a type of operation the hydraulic hammer 102 may perform. Accordingly, the work tool 104 may include any one of, but not limited to, a blunt type, a chisel type, and a cone type work tool. In one embodiment, the hydraulic hammer 102 may be operated by a hydraulic system (not shown) associated with the machine 100. In another embodiment, the hydraulic hammer 102 may be operated by a pneumatic system (not shown) associated with the machine 100. Further, it may be contemplated to use other types of machines and carriers to power the hydraulic hammer 102.

The machine 100 includes a frame 112, a boom member 114, and a stick member 116. The boom member 114 and the stick member 116 articulate relative to the frame 112 in order to change an orientation and/or position of the hydraulic hammer 102, with respect to the work surface 110. The machine 100 includes input devices (not shown) located within an operator cab 118 of the machine 100. The input devices may be used by an operator to operate the hydraulic hammer 102 and/or the machine 100.

Figure 2:
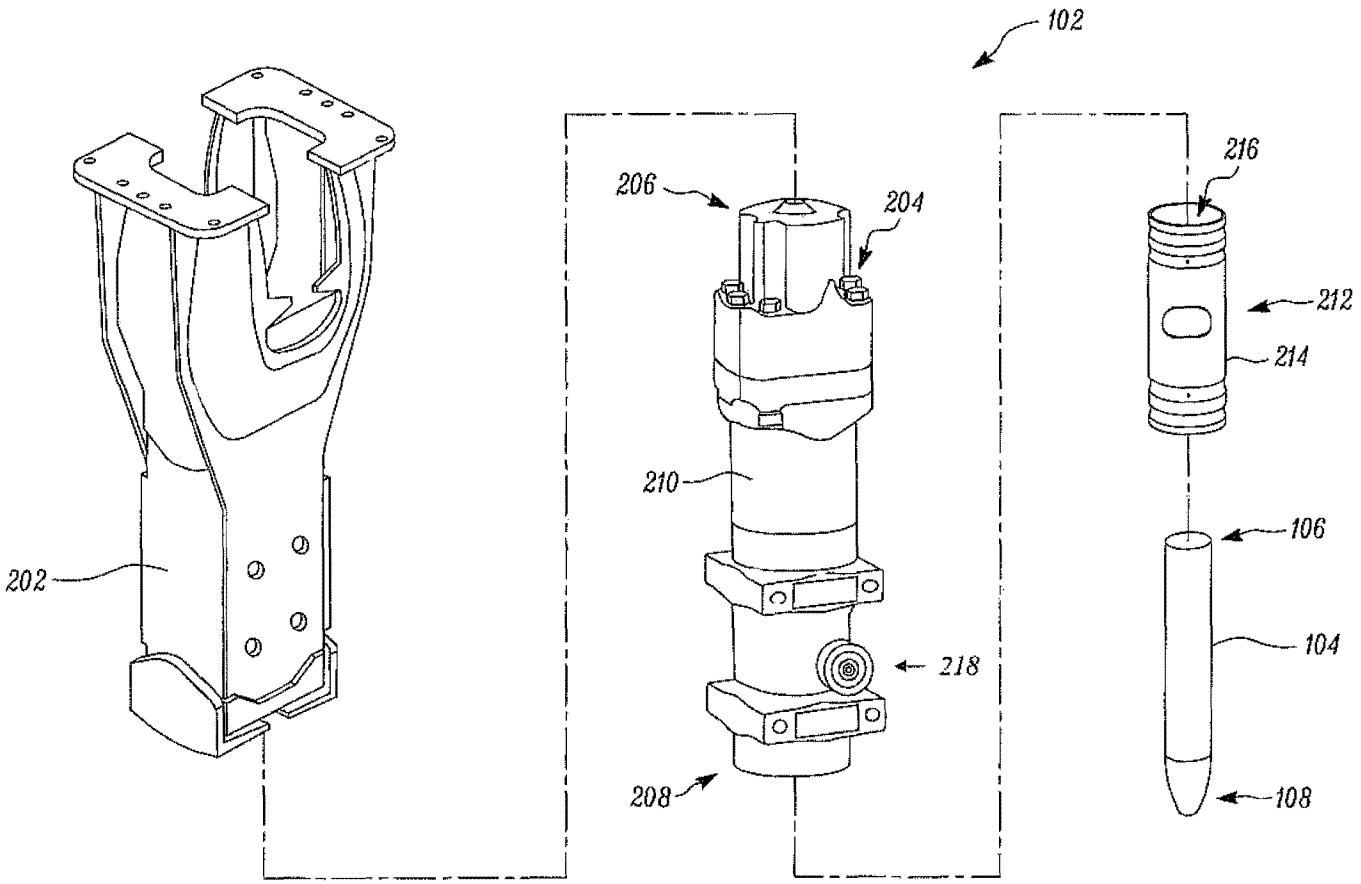
FIG. 2 is an exploded perspective view of a hydraulic hammer of the machine of FIG. 1, according to one embodiment of the present disclosure.
Figure 3:
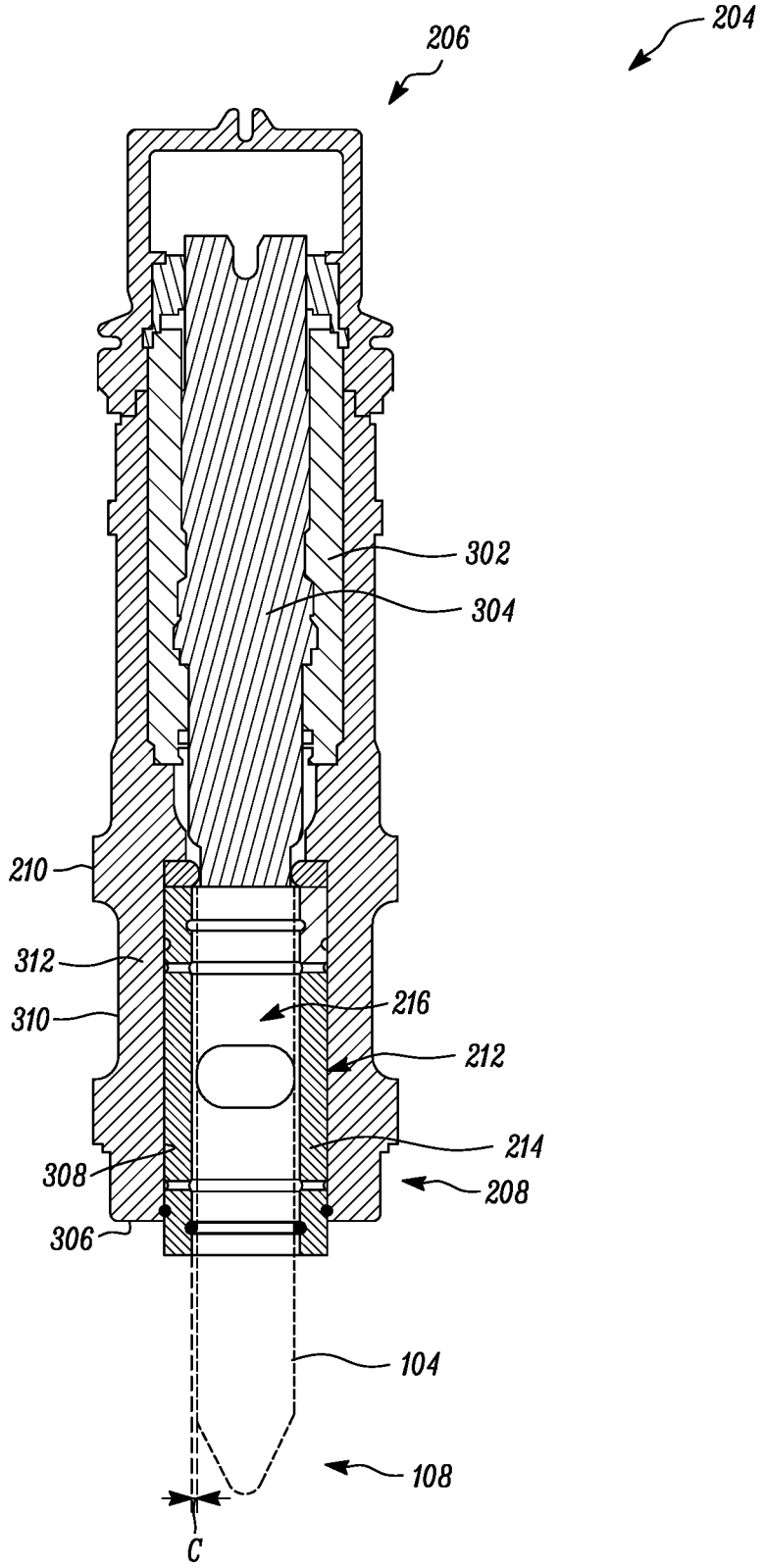
FIG. 3 is an assembled cross sectional view of the hydraulic hammer of FIG. 2, according to one embodiment of the present disclosure.

Referring to FIGS. 2 and 3, the hydraulic hammer 102 includes a housing member 202. The hydraulic hammer 102 also includes a power cell 204 disposed within the housing member 202. During the operation of the hydraulic hammer 102, the power cell 204 drives the work tool 104 such that the work tool 104 may perform functions that are consistent with the present disclosure. The power cell 204 includes a first end 206 and a second end 208. The work tool 104 is coupled to the second end 208 of the power cell 204.

The power cell 204 includes an outer casing 210. The outer casing 210 houses one or more components of the power cell 204. The components include a cylinder 302, a piston 304, seals (not shown), lubrication lines (not shown), and so on. The outer casing 210 includes a bottom surface 306. The outer casing 210 also includes an inner surface 308 and an outer surface 310. The outer surface 310 is disposed opposite to the inner surface 308. The inner surface 308 and the outer surface 310 define a wall 312 of the outer casing 210.

The hydraulic hammer 102 includes a reversible bushing kit 212 provided within the outer casing 210 of the power cell 204. The reversible bushing kit 212 includes a reversible bushing 214 having a hollow configuration. The work tool 104 is received within a hollow portion 216 of the reversible bushing 214. The reversible bushing 214 is disposed between the wall 312 and the work tool 104, at the second end 208 of the power cell 204. The reversible bushing 214 extends in a downward direction from the power cell 204 adjacent to the bottom surface 306. The reversible bushing 214 guides the work tool 104 inside the power cell 204 during the operation of the hydraulic hammer 102.

Figure 4:
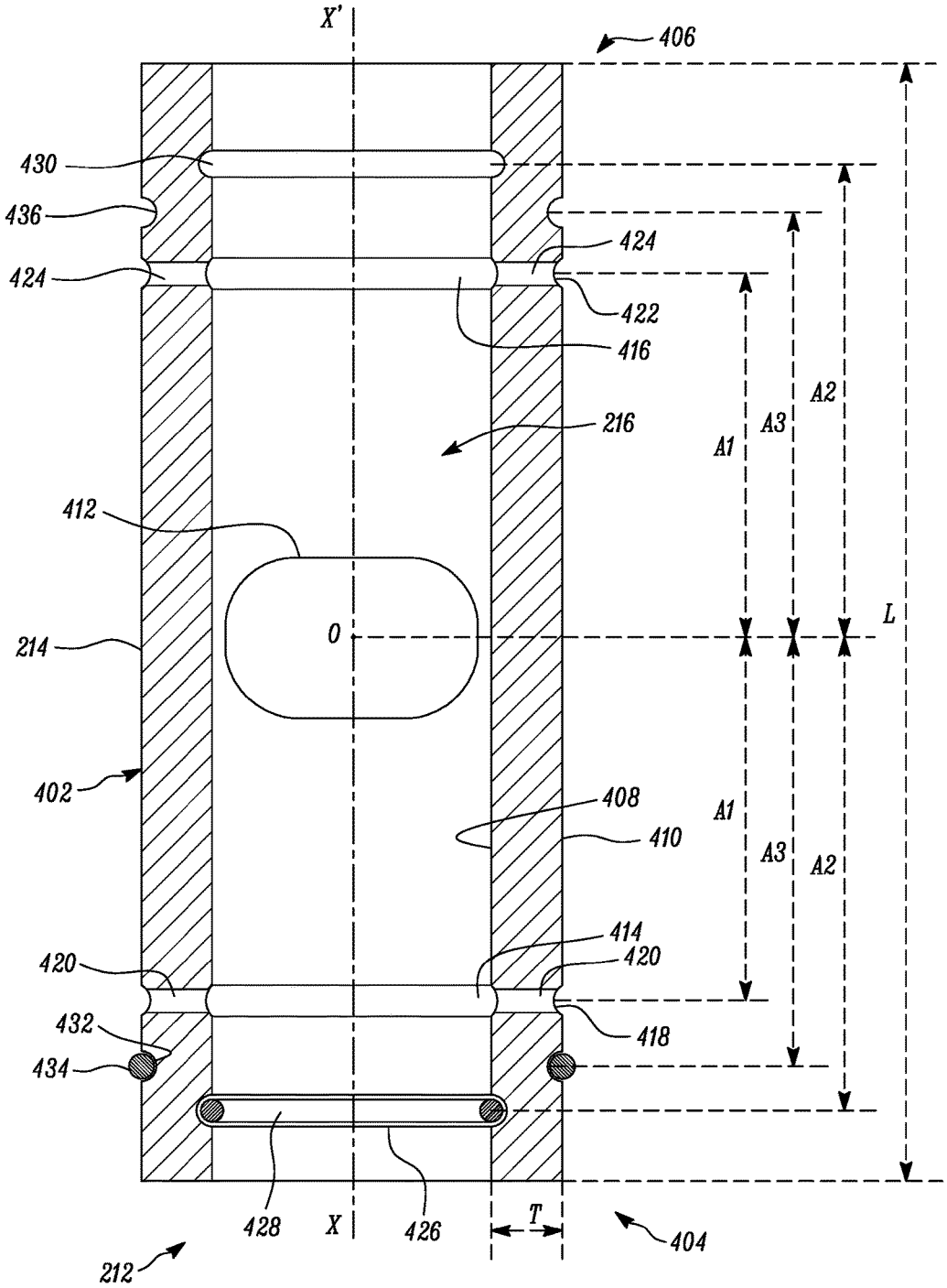
FIG. 4 is a cross sectional view of a reversible bushing of the hydraulic hammer of FIG. 2, according to one embodiment of the present disclosure.
Figure 5:
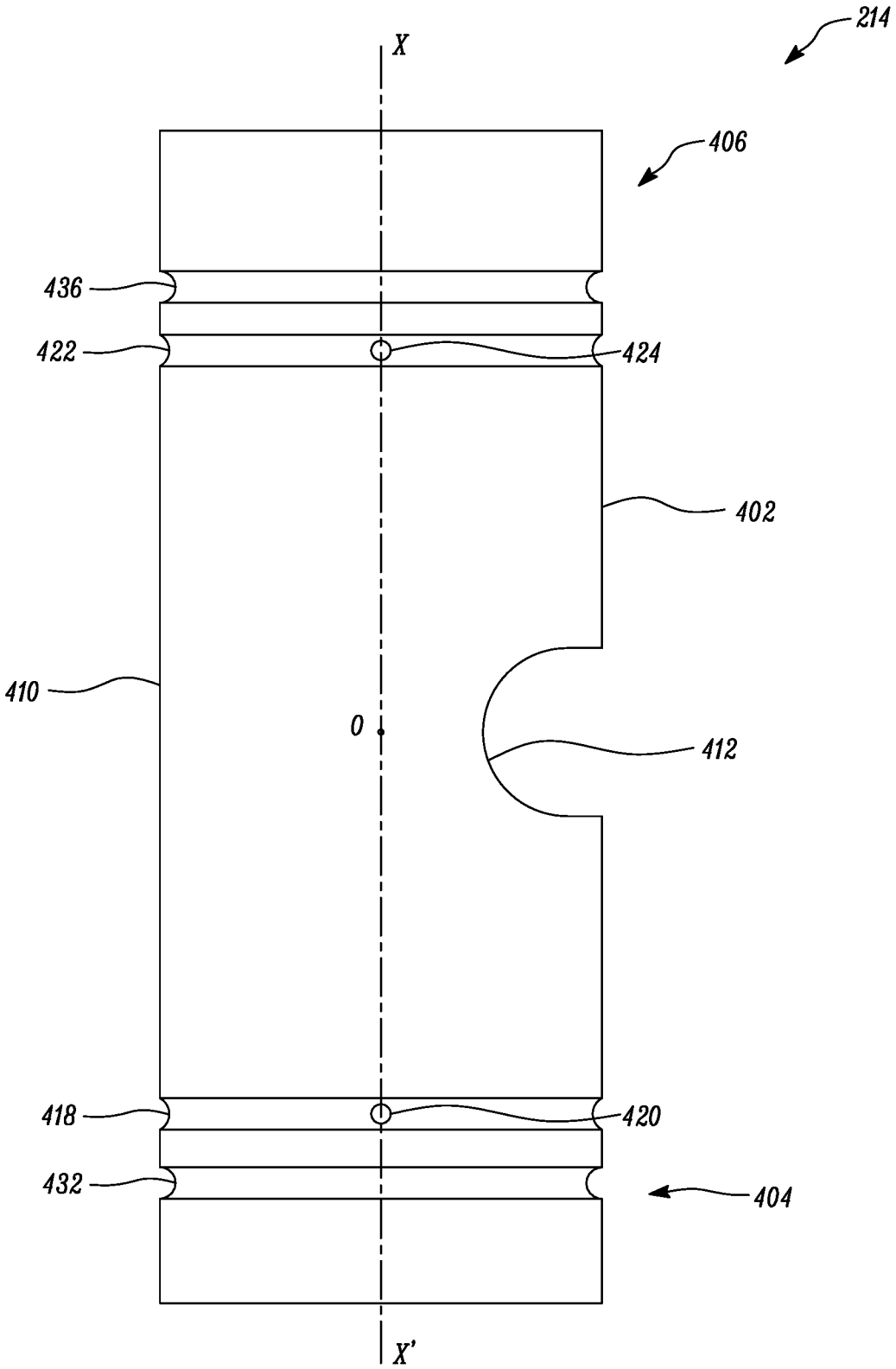
FIG. 5 is a side view of the reversible bushing of FIG. 4, according to one embodiment of the present disclosure.

The reversible bushing 214 will now be explained in detail with reference to FIGS. 4, 5 and 6. The reversible bushing 214 includes a body 402. The body 402 has a hollow and elongated configuration. In the illustrated embodiment, the body 402 includes a cylindrical configuration. In other embodiments, the body 402 may include any other configuration, such as a rectangular configuration, a triangular configuration, and so on, based on application requirements.

Accordingly, the body 402 defines a longitudinal axis X-X' thereof. Also, the body 402 defines a center of symmetry "O" thereof located on the longitudinal axis X-X'. The body 402 includes a first end 404 and a second end 406. The second end 406 is distal with respect to the first end 404. Accordingly, the longitudinal axis X-X' extends between the first end 404 and the second end 406. The body 402 also includes an inner surface 408 and an outer surface 410. The outer surface 410 is disposed opposite the inner surface 408. Accordingly, the body 402 defines a thickness "T" thereof between the inner surface 408 and the outer surface 410.

It may be contemplated that the thickness "T" of the reversible bushing 214 may vary along a length "L" of the reversible bushing 214, based on dimensions of the hydraulic hammer 102 and the work tool 104. Further, the reversible bushing 214 may be manufactured using any manufacturing method, such as casting, forging, fabrication, additive manufacturing, and so on, without any limitations. Further, the reversible bushing 214 may be made of any metal and/or non-metal known in the art, without limiting the scope of the present disclosure.

The body 402 includes a first notch 412 provided therein. More specifically, the first notch 412 is centered on the center of symmetry "O". In the illustrated embodiment, the first notch 412 includes a C-shaped configuration. In other embodiments, the first notch 412 may include any other configuration based on application requirements. The first notch 412 receives a retention pin 218 (shown in FIG. 2) of the hydraulic hammer 102. The retention pin 218 in association with the first notch 412 limits movement of the reversible bushing 214 within the hydraulic hammer 102 during the operation thereof.

In the illustrated embodiment, the first notch 412 is provided within the body 402 extending across the outer surface 410 and the inner surface 408. More specifically, the first notch 412 extends along the thickness "T" and partially along a circumference of the body 402. In other embodiments, the first notch 412 may be provided extending only part way along the thickness "T" and the circumference of the body 402. In such a situation, the first notch 412 may extend from the outer surface 410 towards the inner surface 408 without cutting through the inner surface 408.

Figure 6:
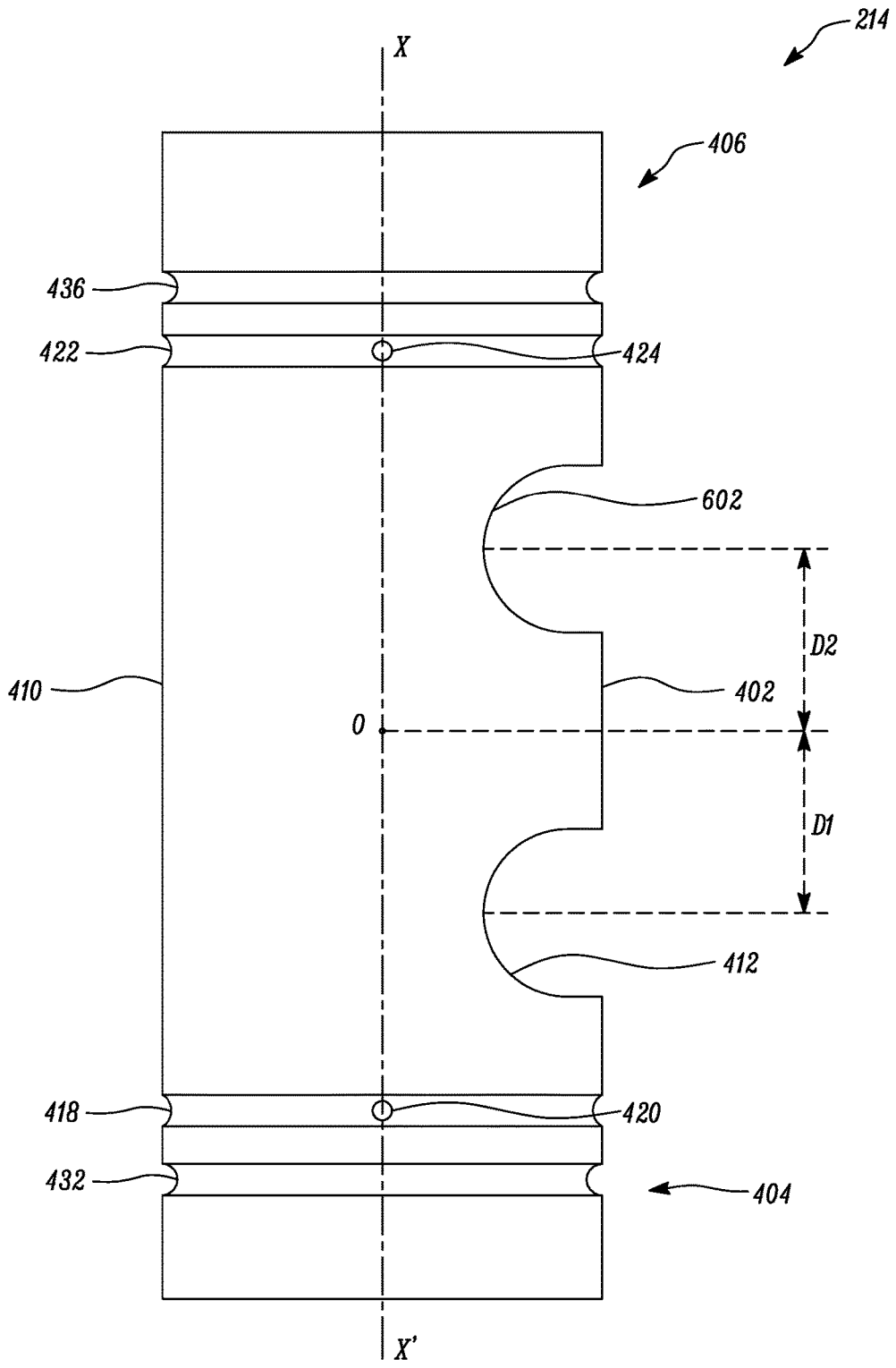
FIG. 6 is a side view of a reversible bushing of the hydraulic hammer of FIG. 2, according to another embodiment of the present disclosure.

In another embodiment, as shown in FIG. 6, the body 402 includes a second notch 602 provided in relation to the center of symmetry "O". In such a situation, the first notch 412 is provided at a first distance "D1" with respect to the center of symmetry "O" toward the first end 404. Also, the second notch 602 is provided at a second distance "D2" with respect to the center of symmetry "O" toward the second end 406. More specifically, the first distance "D1" is equal to the second distance "D2". Accordingly, the first notch 412 and the second notch 602 are equidistant with respect to the center of symmetry "O".

In the illustrated embodiment, the second notch 602 includes a C-shaped configuration. In other embodiments, the second notch 602 may include any other configuration based on application requirements. The second notch 602 receives the retention pin 218 (shown in FIG. 2) of the hydraulic hammer 102. The retention pin 218 in association with the second notch 602 limits movement of the reversible bushing 214 within the hydraulic hammer 102 during the operation thereof.

In the illustrated embodiment, the second notch 602 is provided within the body 402 extending across the outer surface 410 and the inner surface 408. More specifically, the second notch 602 extends along the thickness "T" and partially along the circumference of the body 402. In other embodiments, the second notch 602 may be provided extending only part way along the thickness "T" and the circumference of the body 402. In such a situation, the second notch 602 may extend from the outer surface 410 towards the inner surface 408 without cutting through the inner surface 408.

The body 402 includes a first channel 414 provided on the first end 404 of the body 402. More specifically, the first channel 414 is provided on the inner surface 408 of the body 402. The first channel 414 is provided at a distance "A1" from the center of symmetry "O". In the illustrated embodiment, the first channel 414 includes a circular, ring like configuration. In other embodiments, the first channel 414 may include any other configuration, such as semicircular, helical, wave like, and so on, based on application requirements. The first channel 414 is adapted to provide lubrication on the inner surface 408 of the reversible bushing 214.

The body 402 also includes a second channel 416 provided on the second end 406 of the body 402. More specifically, the second channel 416 is provided on the inner surface 408 of the body 402. The second channel 416 is provided at the distance "A1" from the center of symmetry "O". As such, the first channel 414 and the second channel 416 are equidistant with respect to the center of symmetry "O". In the illustrated embodiment, the second channel 416 includes a circular, ring like configuration. In other embodiments, the second channel 416 may include any other configuration, such as semicircular, helical, wave like, and so on, based on application requirements. The second channel 416 is adapted to provide lubrication on the inner surface 408 of the reversible bushing 214.

The body 402 includes a third channel 418 provided on the first end 404 of the body 402. The third channel 418 is provided on the outer surface 410 of the body 402. More specifically, the third channel 418 is provided in association and adjacent to the first channel 414. The third channel 418 is provided at the distance "A1" from the center of symmetry "O". In the illustrated embodiment, the third channel 418 includes a circular, ring like configuration. In other embodiments, the third channel 418 may include any other configuration, such as semicircular, helical, wave like, and so on, based on application requirements. The third channel 418 in association with the first channel 414 is adapted to provide lubrication on the inner surface 408 of the reversible bushing 214.

The body 402 also includes a first bore 420 provided therein. The first bore 420 extends along the thickness "T" between the first channel 414 and the third channel 418. In the illustrated embodiment, the body 402 includes two first bores 420 diagonally opposing one another. In other embodiments, the body 402 may include a single or multiple first bores 420 provided in any configuration therein based on application requirements. The first bore 420 is adapted to provide a path for a flow of a lubricant from the third channel 418 towards the first channel 414.

The body 402 further includes a fourth channel 422 provided on the second end 406 of the body 402. The fourth channel 422 is provided on the outer surface 410 of the body 402. More specifically, the fourth channel 422 is provided in association and adjacent to the second channel 416. The fourth channel 422 is provided at the distance "A1" from the center of symmetry "O". As such, the third channel 418 and the fourth channel 422 are equidistant with respect to the center of symmetry "O". In the illustrated embodiment, the fourth channel 422 includes a circular, ring like configuration. In other embodiments, the fourth channel 422 may include any other configuration, such as semicircular, helical, wave like, and so on, based on application requirements. The fourth channel 422 in association with the second channel 416 is adapted to provide lubrication on the inner surface 408 of the reversible bushing 214.

The body 402 also includes a second bore 424 provided therein. The second bore 424 extends along the thickness "T" between the second channel 416 and the fourth channel 422. In the illustrated embodiment, the body 402 includes two second bores 424 diagonally opposing one another. In other embodiments, the body 402 may include a single or multiple second bores 424 provided in any configuration therein based on application requirements. The second bore 424 is adapted to provide a path for a flow of a lubricant from the fourth channel 422 towards the second channel 416.

In order to provide a smooth movement of the work tool 104 within the reversible bushing 214 and to reduce wear and tear of the work tool 104, the lubricant may be provided within the hydraulic hammer 102. The lubricant may be provided by a manual lubrication method and/or an automated lubrication method using a lubrication system (not shown) known in the art. The lubricant may be of different types specific to the application of the machine 100, such as a grease based lubricant.

On the first end 404 of the reversible bushing 214, the lubricant may be received in the third channel 418 via the lubrication system and may be further received in the first channel 414 through the first bore 420. On the second end 406 of the reversible bushing 214, the lubricant may be received in the fourth channel 422 via the lubrication system and may be further received in the second channel 416 through the second bore 424. Accordingly, the lubricant may fill a clearance "C" (shown in FIG. 3) between the reversible bushing 214 and the work tool 104.

Additionally, the body 402 includes a first groove 426 provided on the first end 404 of the body 402. More specifically, the first groove 426 is provided on the inner surface 408 of the body 402. The first groove 426 is provided spaced apart with respect to the first channel 414. The first groove 426 is provided at a distance "A2" from the center of symmetry "O". The distance "A2" is greater than the distance "A1". In the illustrated embodiment, the first groove 426 includes a circular, ring like configuration. In other embodiments, the first groove 426 may include any other configuration, such as helical, wave like, and so on, based on application requirements.

The first groove 426 is adapted to selectively receive a first sealing element 428 of the reversible bushing kit 212 therein. The first sealing element 428 may be any sealing element known in the art, such as an O-ring. During operation, the first sealing element 428 is adapted to limit infiltration of contamination between the work tool 104 and the inner surface 408 of the reversible bushing 214. Also, the first sealing element 428 is adapted to limit leakage of the lubricant from between the work tool 104 and the inner surface 408 of the reversible bushing 214.

The body 402 also includes a second groove 430 provided on the second end 406 of the body 402. More specifically, the second groove 430 is provided on the inner surface 408 of the body 402. The second groove 430 is provided spaced apart with respect to the second channel 416. The second groove 430 is provided at the distance "A2" from the center of symmetry "O". As such, the first groove 426 and the second groove 430 are equidistant with respect to the center of symmetry "O". In the illustrated embodiment, the second groove 430 includes a circular, ring like configuration. In other embodiments, the second groove 430 may include any other configuration, such as helical, wave like, and so on, based on application requirements.

The second groove 430 is adapted to selectively receive a second sealing element (not shown) of the reversible bushing kit 212 therein. The second sealing element is similar to the first sealing element 428. Accordingly, the second sealing element may be any sealing element known in the art, such as an O-ring. During operation, the second sealing element is adapted to limit infiltration of contamination between the work tool 104 and the inner surface 408 of the reversible bushing 214. Also, the second sealing element is adapted to limit leakage of the lubricant from between the work tool 104 and the inner surface 408 of the reversible bushing 214.

The body 402 also includes a third groove 432 provided on the first end 404 of the body 402. More specifically, the third groove 432 is provided on the outer surface 410 of the body 402. The third groove 432 is provided spaced apart with respect to the third channel 418. The third groove 432 is provided at a distance "A3" from the center of symmetry "O". The distance "A3" is greater than the distance "A1". In the illustrated embodiment, the third groove 432 includes a circular, ring like configuration. In other embodiments, the third groove 432 may include any other configuration, such as helical, wave like, and so on, based on application requirements.

The third groove 432 is adapted to selectively receive a third sealing element 434 of the reversible bushing kit 212 therein. The third sealing element 434 may be any sealing element known in the art, such as an O-ring. During operation, the third sealing element 434 is adapted to limit infiltration of contamination between the wall 312 of the outer casing 210 of the power cell 204 and the outer surface 410 of the reversible bushing 214. Also, the third sealing element 434 is adapted to limit leakage of the lubricant from between the wall 312 of the outer casing 210 of the power cell 204 and the outer surface 410 of the reversible bushing 214.

The body 402 further includes a fourth groove 436 provided on the second end 406 of the body 402. More specifically, the fourth groove 436 is provided on the outer surface 410 of the body 402. The fourth groove 436 is provided spaced apart with respect to the fourth channel 422. The fourth groove 436 is provided at the distance "A3" from the center of symmetry "O". As such, the third groove 432 and the fourth groove 436 are equidistant with respect to the center of symmetry "O". In the illustrated embodiment, the fourth groove 436 includes a circular, ring like configuration. In other embodiments, the fourth groove 436 may include any other configuration, such as helical, wave like, and so on, based on application requirements.

The fourth groove 436 is adapted to selectively receive a fourth sealing element (not shown) of the reversible bushing kit 212 therein. The fourth sealing element is similar to the third sealing element 434. Accordingly, the fourth sealing element may be any sealing element known in the art, such as an O-ring. During operation, the fourth sealing element is adapted to limit infiltration of contamination between the wall 312 of the outer casing 210 of the power cell 204 and the outer surface 410 of the reversible bushing 214. Also, the fourth sealing element is adapted to limit leakage of the lubricant from between the wall 312 of the outer casing 210 of the power cell 204 and the outer surface 410 of the reversible bushing 214.

INDUSTRIAL APPLICABILITY

Figure 7:
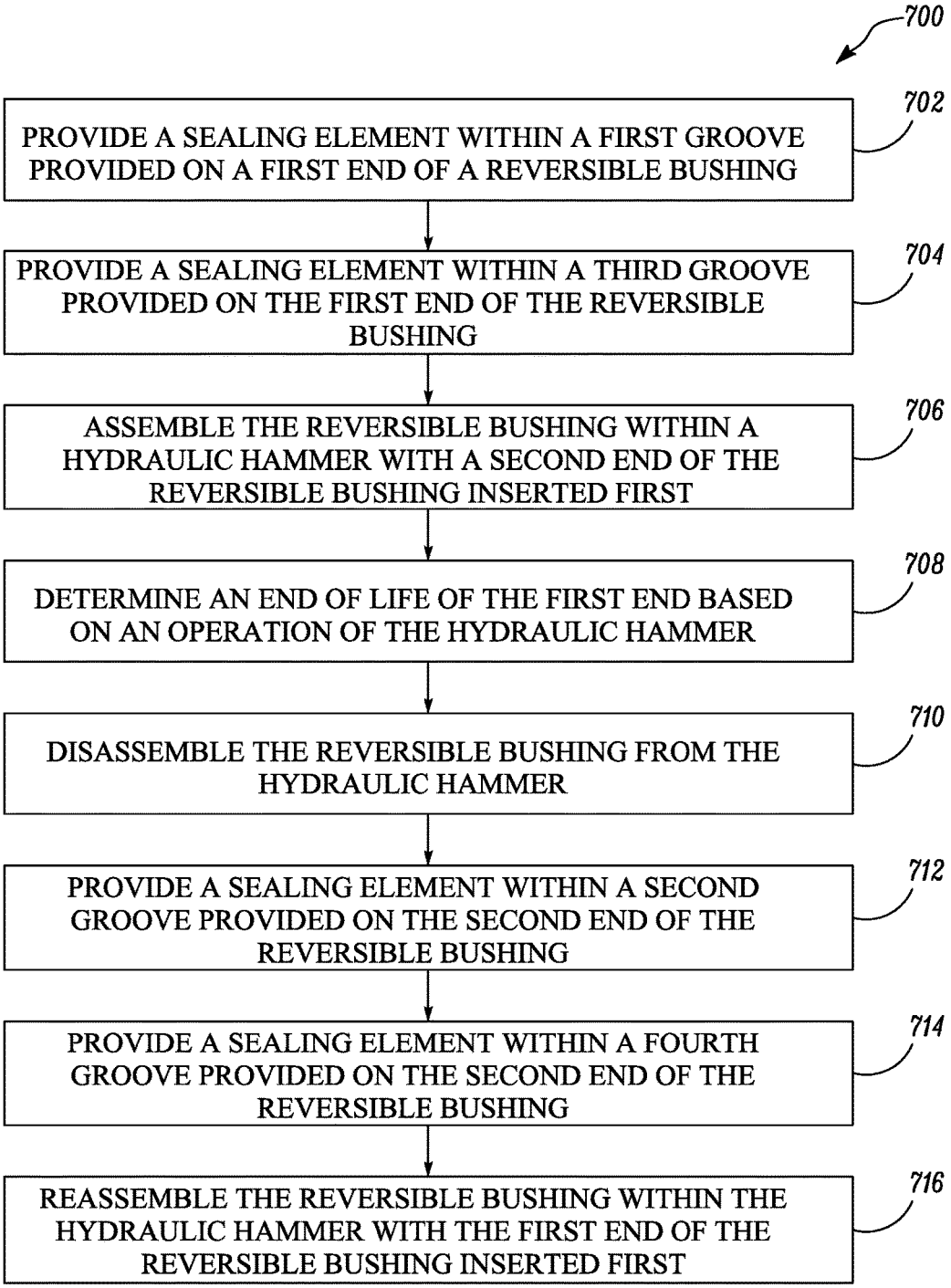
FIG. 7 is a flowchart of a method of using the reversible bushing of FIGS. 4 and 6 with the hydraulic hammer of FIG. 2, according to one embodiment of the present disclosure.

The present disclosure relates to a method 700 of using the reversible bushing 214 within the hydraulic hammer 102. Referring to FIG. 7, a flowchart of the method 700 is illustrated. At step 702, the sealing element is provided within the first groove 426 provided on the first end 404 of the reversible bushing 214. More specifically, the sealing element is the first sealing element 428, such as the O-ring. At step 704, the sealing element is provided within the third groove 432 provided on the first end 404 of the reversible bushing 214. More specifically, the sealing element is the third sealing element 434, such as the O-ring.

At step 706, the reversible bushing 214 is assembled within the hydraulic hammer 102 along with the first sealing element 428 and the third sealing element 434. The reversible bushing 214 is assembled in a manner such that the second end 406 is inserted first within the hydraulic hammer 102. As such, after assembly, the first end 404 of the reversible bushing 214 is disposed adjacent to the bottom surface 306 of the outer casing 210 of the power cell 204, and the second end 406 of the reversible bushing 214 is disposed distally within the power cell 204.

At step 708, an end of life of the first end 404 of the reversible bushing 214 is determined based on the operation of the hydraulic hammer 102. More specifically, based on the operation of the hydraulic hammer 102, the first end 404 of the reversible bushing 214 may experience wear and tear resulting in the end of life thereof. At step 710, the reversible bushing 214 is disassembled from within the hydraulic hammer 102. The reversible bushing 214 may be disassembled by extracting the first end 404 first. The reversible bushing 214 may be disassembled by using any tool or disassembling method known in the art.

At step 712, the sealing element is provided within the second groove 430 provided on the second end 406 of the reversible bushing 214. More specifically, the second sealing element is provided within the second groove 430. At step 714, the sealing element is provided within the fourth groove 436 provided on the second end 406 of the reversible bushing 214. More specifically, the fourth sealing element is provided within the fourth groove 436.

At step 716, the reversible bushing 214 is reversed and reassembled within the hydraulic hammer 102 along with the second sealing element and the fourth sealing element. The reversible bushing 214 is assembled in a manner such that the worn off first end 404 is inserted first within the hydraulic hammer 102. As such, after assembly, the second end 406 of the reversible bushing 214 is disposed adjacent to the bottom surface 306 of the outer casing 210 of the power cell 204, and the worn off first end 404 of the reversible bushing 214 is disposed distally within the power cell 204.

Additionally or optionally, the first sealing element 428 provided within the first groove 426 is removed therefrom prior to reversing and reassembling the reversible bushing 214. Similarly, the third sealing element 434 provided within the third groove 432 is removed therefrom prior to reversing and reassembling the reversible bushing 214. Accordingly, the reversible bushing 214 may be used until the second end 406 may wear off based on the operation of the hydraulic hammer 102.

The reversible bushing 214 and the method 700 provides a simple, cost effective design and method of increasing the usable life of a conventional bushing. As such, the first end 404 of the reversible bushing 214 may be used until the end of life thereof. Thereafter, the reversible bushing 214 may be reversed to use the second end 406 of the reversible bushing 214 until the end of life thereof. Accordingly, the reversible bushing 214 may provide to approximately double the usable life of the conventional bushing. As a result, the reversible bushing 214 may provide to reduce maintenance and service costs associated with the hydraulic hammer 102. The reversible bushing 214 may be retrofitted in any conventional hydraulic hammer 102 with little or no modifications to the existing system design.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A reversible bushing for a hydraulic hammer, the reversible bushing comprising:

a body having an elongated configuration defining a longitudinal axis, the body having a first end and a second end distal with respect to the first end, the body having an inner surface and an outer surface disposed opposite with respect to the inner surface, the body defining a center of symmetry on the longitudinal axis;

a first notch provided in relation to the center of symmetry, the first notch extending at least partially along the body;

a first channel provided on the first end of the body, the first channel extending at least partially along the inner surface of the body;

a second channel provided on the second end of the body, the second channel extending at least partially along the inner surface of the body;

a first groove provided on the first end of the body, the first groove provided spaced apart with respect to the first channel, the first groove extending at least partially along the inner surface of the body; and a second groove provided on the second end of the body, the second groove provided spaced apart with respect to the second channel, the second groove extending at least partially along the inner surface of the body, wherein the first channel and the second channel are equidistant with respect to the center of symmetry, and wherein the first groove and the second groove are equidistant with respect to the center of symmetry.

2. The reversible bushing of claim 1, wherein the first notch is centered on the center of symmetry.

3. The reversible bushing of claim 1 further including a second notch provided in relation to the center of symmetry, the second notch extending at least partially along the body, wherein the first notch is positioned at a first distance from the center of symmetry toward the first end, and the second notch is positioned at a second distance from the center of symmetry toward the second end, and wherein the first distance is equal to the second distance.

4. The reversible bushing of claim 3, wherein the first notch and the second notch includes a C-shaped configuration.

5. The reversible bushing of claim 1 further including:

a third channel provided in association with the first channel, the third channel extending at least partially along the outer surface of the body; and a fourth channel provided in association with the second channel, the fourth channel extending at least partially along the outer surface of the body, wherein the third channel and the fourth channel are equidistant with respect to the center of symmetry.

6. The reversible bushing of claim 5 further including a first bore provided within the body, the first bore extending between the first channel and the third channel.

7. The reversible bushing of claim 5 further including a second bore provided within the body, the second bore extending between the second channel and the fourth channel.

8. The reversible bushing of claim 1 further including:

a third groove provided on the first end of the body, the third groove extending at least partially along the outer surface of the body; and a fourth groove provided on the second end of the body, the fourth groove extending at least partially along the outer surface of the body, wherein the third groove and the fourth groove are equidistant with respect to the center of symmetry.

9. The reversible bushing of claim 8 further including a sealing element selectively provided within the third groove and the fourth groove.

10. The reversible bushing of claim 1 further including a sealing element selectively provided within the first groove and the second groove.

11. The reversible bushing of claim 1, wherein the body includes a cylindrical configuration.

12. A reversible bushing kit for a hydraulic hammer, the reversible bushing kit comprising:

a reversible bushing including:

a body having an elongated configuration defining a longitudinal axis, the body having a first end and a second end distal with respect to the first end, the body having an inner surface and an outer surface disposed opposite with respect to the inner surface, the body defining a center of symmetry on the longitudinal axis;

a first notch provided in relation to the center of symmetry, the first notch extending at least partially along the body;

a first channel provided on the first end of the body, the first channel extending at least partially along the inner surface of the body;

a second channel provided on the second end of the body, the second channel extending at least partially along the inner surface of the body;

a first groove provided on the first end of the body, the first groove provided spaced apart with respect to the first channel, the first groove extending at least partially along the inner surface of the body; and a second groove provided on the second end of the body, the second groove provided spaced apart with respect to the second channel, the second groove extending at least partially along the inner surface of the body, wherein the first channel and the second channel are equidistant with respect to the center of symmetry, and wherein the first groove and the second groove are equidistant with respect to the center of symmetry; and a sealing element selectively provided within the first groove and the second groove.

13. The reversible bushing kit of claim 12, wherein the first notch is centered on the center of symmetry.

14. The reversible bushing kit of claim 13 further including:

a third groove provided on the first end of the body, the third groove extending at least partially along the outer surface of the body;

a fourth groove provided on the second end of the body, the fourth groove extending at least partially along the outer surface of the body; and a sealing element selectively provided within the third groove and the fourth groove, wherein the third groove and the fourth groove are equidistant with respect to the center of symmetry.

15. The reversible bushing kit of claim 12 further including a second notch provided in relation to the center of symmetry, the second notch extending at least partially along the body, wherein the first notch is positioned at a first distance from the center of symmetry toward the first end, and the second notch is positioned at a second distance from the center of symmetry toward the second end, and wherein the first distance is equal to the second distance.

16. The reversible bushing kit of claim 12 further including:

a third channel provided in association with the first channel, the third channel extending at least partially along the outer surface of the body; and a fourth channel provided in association with the second channel, the fourth channel extending at least partially along the outer surface of the body, wherein the third channel and the fourth channel are equidistant with respect to the center of symmetry.

17. The reversible bushing kit of claim 16 further including a first bore provided within the body, the first bore extending between the first channel and the third channel.

18. The reversible bushing kit of claim 16 further including a second bore provided within the body, the second bore extending between the second channel and the fourth channel.

* * * * *